US006848129B1

(12) United States Patent
Amato et al.

(10) Patent No.: US 6,848,129 B1
(45) Date of Patent: Feb. 1, 2005

(54) CRIB APPARATUS WITH SLIDE-OUT MATTRESS ACCESS

(75) Inventors: Mary Anne G. Amato, Lido Beach, NY (US); Johan A. Julin, West Hollywood, CA (US)

(73) Assignee: Research for Strategic Management, LLC, West Hollywood, CA (US)

( * ) Notice: Subject to any disclaimer, the term of this patent is extended or adjusted under 35 U.S.C. 154(b) by 0 days.

(21) Appl. No.: 10/660,129

(22) Filed: Sep. 11, 2003

(51) Int. Cl.[7] ..... A47D 7/00
(52) U.S. Cl. ..... 5/99.1; 5/97
(58) Field of Search ..... 5/99.1, 100, 93.1, 5/97

(56) References Cited

U.S. PATENT DOCUMENTS

| | | | | |
|---|---|---|---|---|
| 949,389 | A | | 2/1910 | Almgren |
| 1,211,762 | A | | 1/1917 | Sawyer |
| 2,267,176 | A | | 12/1941 | Turner |
| 2,477,231 | A | | 7/1949 | Bourdon |
| 2,486,466 | A | * | 11/1949 | Davis ..... 5/93.1 |
| 2,555,160 | A | | 5/1951 | Schwarz |
| 4,146,885 | A | * | 3/1979 | Lawson, Jr. ..... 600/534 |
| 4,706,312 | A | | 11/1987 | Shamie |
| 4,715,075 | A | | 12/1987 | Shamie |
| 4,811,436 | A | | 3/1989 | Schwartz |
| 5,054,138 | A | | 10/1991 | Wesley |
| 5,416,934 | A | | 5/1995 | Bracken et al. |
| 5,884,348 | A | | 3/1999 | Onishi et al. |
| 5,926,870 | A | | 7/1999 | Branca-Barnes et al. |

* cited by examiner

*Primary Examiner*—Michael F. Trettel
*Assistant Examiner*—Fredrick Conley

(57) ABSTRACT

A crib apparatus comprises a headboard and a footboard, the headboard and footboard being spaced from and arranged substantially parallel to one another, and first and second side rails. The first and second side rails are spaced from and arranged substantially parallel to one another and substantially orthogonal to the headboard and the footboard. Each of the first and second side rails is operatively attached to the headboard and footboard. The crib apparatus further includes a mattress frame for supporting a mattress, the mattress frame being operatively attached to at least the headboard and footboard and being substantially orthogonal to the headboard, footboard and side rails. At least one of the headboard and the footboard includes an access opening therein through which the mattress can be slidably removed from the crib apparatus.

20 Claims, 4 Drawing Sheets

CRIB APPARATUS WITH SLIDE-OUT MATTRESS ACCESS

FIELD OF THE INVENTION

The present invention relates generally to infant cribs, and more particularly relates to a crib apparatus configurable for accessing a mattress in slide-out manner.

BACKGROUND OF THE INVENTION

Infant cribs and their application are well-established. Various modifications to the basic crib design have been proposed in the prior art for providing enhancements, in terms of safety, care and ease of operation. When changing crib bedding (e.g., sheets, mattress pad, etc), as is often required, most crib designs typically allow access to the crib mattress only by reaching over the side rails of the crib. This arrangement is often inconvenient and cumbersome, especially when using padding (e.g., bumpers) or other protection materials around the sides of the crib, which must typically be removed to enable the mattress to be at least partially removed from the crib for changing the crib bedding.

This problem has been inadequately addressed in the prior art. For example, U.S. Pat. No. 5,054,138 to Wesley describes a crib apparatus including a mattress cavity and a mattress that is slidably mounted to the mattress cavity. Access to the mattress is provided through an opening in the mattress cavity that is coextensive with a forward wall (i.e., long dimension) of the crib. This configuration, however, prevents the side rails from being lowered while the mattress is being removed from the crib and is thus undesirable.

Similarly, U.S. Pat. No. 5,416,934 to Bracken et al. describes a crib having a mattress frame and mattress that can be pulled outwardly away from the front perimeter (i.e., long dimension) of the crib. Once pulled out, the mattress is exposed, thereby allowing mattress coverings to be more easily changed. However, like the Wesley patent previously discussed, the crib arrangement described by Bracken et al. prevents the side rail which is coextensive with the mattress opening from being lowered once the mattress has been pulled out from the crib.

There exists a need, therefore, for a crib apparatus that allows slidable access to the mattress but does not inhibit the lowering of the side rails once the mattress has been at least partially removed from the crib.

SUMMARY OF THE INVENTION

The present invention provides an improved crib apparatus for more easily accessing and removing a mattress without preventing the use of other desirable features of the crib apparatus, such as the ability to lower one or both side rails.

In accordance with one aspect of the invention, a crib apparatus comprises a headboard and a footboard, the headboard and footboard being spaced from and arranged substantially parallel to one another, and first and second side rails. The first and second side rails are spaced from and arranged substantially parallel to one another and substantially orthogonal to the headboard and the footboard. Each of the first and second side rails is operatively attached to the headboard and footboard. The crib apparatus further includes a mattress frame for supporting a mattress, the mattress frame being operatively attached to at least the headboard and footboard and being substantially orthogonal to the headboard, footboard and side rails. At least one of the headboard and the footboard includes an access opening therein through which the mattress can be slidably removed from the crib apparatus.

These and other features and advantages of the present invention will become apparent from the following detailed description of illustrative embodiments thereof, which is to be read in connection with the accompanying drawings.

DETAILED DESCRIPTION OF THE PREFERRED EMBODIMENTS

The present invention will be described herein in the context of an illustrative infant crib apparatus. It should be appreciated, however, that the present invention is not limited to this or any particular crib arrangement. Furthermore, the material used to form the crib apparatus may include, for example, wood and/or metal, but it is to be appreciated that the invention is not limited to a particular type or types of material. Rather, the invention is more generally applicable to a crib apparatus configurable for accessing a mattress in a slide-out manner.

Figure 1:
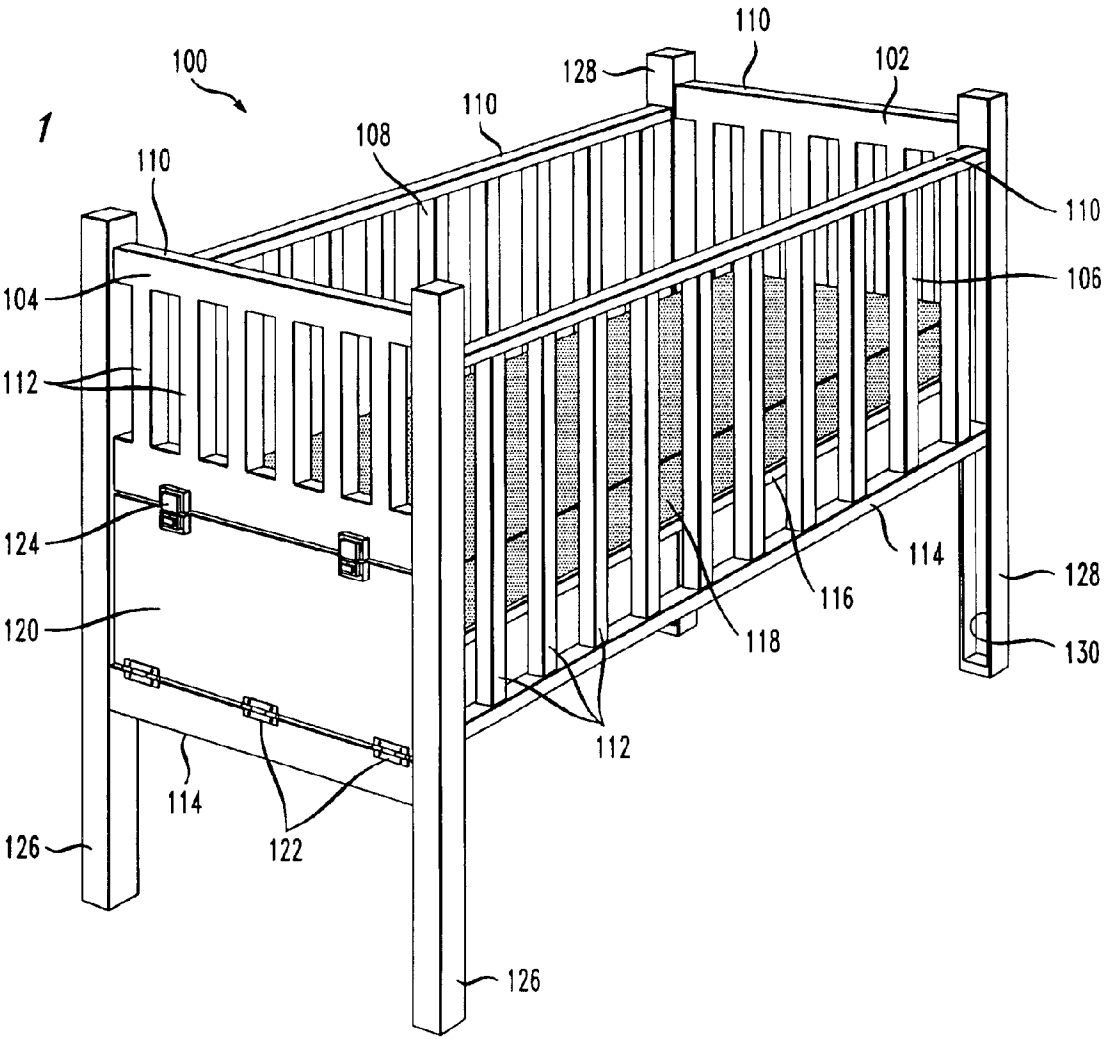
FIG. 1 is a perspective view of an exemplary crib apparatus, formed in accordance with an illustrative embodiment of the present invention.

FIG. 1 illustrates an exemplary crib apparatus 100 formed in accordance with one embodiment of the invention. The exemplary crib apparatus 100 comprises a headboard 102 and a footboard 104 spaced apart and arranged substantially parallel to one another, and two side rails 106 and 108 spaced apart and arranged substantially parallel to one another and substantially orthogonal to the headboard 102 and/or footboard 104. The headboard 102 and footboard 104 may be formed to be essentially identical to one another, and thus the designations of headboard and footboard may be arbitrarily assigned. Likewise, the two side rails 106, 108 may be formed to be substantially the same relative to one another. As the terms are employed herein, the headboard 102 and footboard 104 are intended to define a first dimension of the crib apparatus 100 and the side rails 106, 108 are intended to define a second dimension of the crib apparatus, wherein the first dimension is smaller than the second dimension.

Each of the headboard 102 and footboard 104 preferably includes a plurality of support members or legs 128 and 126, respectively, associated therewith which maybe positioned at laterally opposite ends of the headboard and footboard.

The support legs 126, 128 may be formed as a portion of the headboard 102 and/or footboard 104 or, alternatively, the support legs may be formed separate from the headboard and/or footboard and attached thereto by way of conventional attachment means (e.g., screws, brackets, etc.), as will be known by those skilled in the art. Moreover, the support legs 126, 128 maybe configured so as to provide selectable height adjustment for raising and lowering the crib apparatus 100. It is to be appreciated that the present invention is not limited to a particular shape, number and/or configuration of the support legs. Each of the side rails 106, 108 is preferably operatively attached to one of the support legs 126 associated with the footboard 104 and to a corresponding one of the support legs 128 associated with the headboard 102. As previously stated, the side rails 106, 108 are preferably attached substantially orthogonal to the headboard 102 and footboard 104.

One or more of the side rails 106, 108, headboard 102 and footboard 104 may be at least partially formed having a plurality of vertical bar members or slats 112, preferably spaced substantially parallel to one another, between a top portion 110 and a bottom portion 114 of a given side rail, headboard, or footboard. At least for safety reasons, the spacing between consecutive vertical slats 112 may be configured such that an infant's head cannot pass through or otherwise become lodged between the slats and yet provide adequate visibility through the side rails, headboard, and/or footboard for maintaining visual contact with the infant or small child.

The exemplary crib apparatus 100 further includes a mattress frame 116 for supporting a mattress 118 in a horizontal plane that is substantially orthogonal with respect to the headboard 102, footboard 104 and side rails 106, 108. The mattress frame 116 may be formed, for example, as a substantially solid floor extending between the side rails 106, 108 and/or between the headboard 102 and footboard 104. Alternatively, the mattress frame 116 may be formed of a plurality of cross members (not shown) extending between the side rails 106, 108 and/or between the headboard 102 and footboard 104. In another illustrative embodiment of the invention (not shown), the mattress frame 116 is formed as a perimeter wall upon which the mattress 118 can be supported and which extends coextensively with two or more of the headboard 102, footboard 104 and side rails 106, 108. Other means for supporting the mattress 118 are contemplated by the present invention, as will be understood by those skilled in the art. With the mattress 118 in place, the mattress forms a floor and the headboard 102, footboard 104 and side rails 106, 108 form an enclosed perimeter surrounding the mattress 118 which, together, defines a cage-like space within which an infant or small child may be placed and maintained.

The mattress frame 116 may be fixedly attached to one or more of the headboard 102, footboard 104 and side rails 106, 108. In one embodiment of the invention, the mattress frame 116 is attached orthogonally to the support legs 126, 128 at each corner of the mattress frame 116. In this configuration, the mattress 118 is preferably slidably mounted in a parallel relationship with the mattress frame 116, thereby providing easy access to and/or removal of the mattress. Alternatively, in a preferred embodiment of the invention, the mattress frame 116 comprises a substantially solid tray, in or upon which the mattress 118 is supported, that is slidably attached to the crib apparatus 100 in relation to at least one of the headboard 102, footboard 104 and side rails 106, 108. In this manner, the mattress 118 and mattress frame 116, together, can be slidably removed from the crib apparatus. At least one end of the tray may include a raised edge or lip portion to facilitate grasping of the mattress frame. Furthermore, the at least one end of the tray may include one or more openings formed therein through which one's fingers or hand may pass, like a handle, to allow the mattress frame 116 to be more easily grasped for removing the mattress 118 from the crib apparatus 100. Although not shown, the mattress frame 116 may be mounted (e.g., attached to the support legs 126, 128) on a slidable track assembly that may include, for example, rollers, etc., or on an alternative slidable mechanism, thus enabling the mattress 118 to be slid out from the crib apparatus like a drawer.

Advantageously, the mattress frame 116 may be configured such that the height of the mattress 118, which rests on and is supported by the mattress frame, can be selectively adjusted (e.g., raised or lowered) as desired. This can be accomplished, for example, by providing a plurality of vertically spaced attachment positions on each of the four support legs, the height of the attachment positions on a given support leg being substantially the same as corresponding attachment positions associated with the other support legs. In this manner, when the mattress frame is attached to the support legs using corresponding attachment positions, the mattress rests on the mattress frame substantially level. As the infant or small child grows, the mattress can be beneficially lowered to prevent the infant or small child from escaping the enclosed space.

The headboard 102 and footboard 104 of the exemplary crib apparatus 100 are preferably fixedly mounted with respect to one another. The two side rails 106, 108 may be fixedly mounted to the headboard 102 and/or footboard 104, such as to the support legs 126, 128, as previously described. In accordance with a preferred embodiment of the invention, one or both side rails 106, 108 are slidably mounted to the headboard 102 and footboard 104 such that one or both side rails can be advantageously lowered and raised between two or more different vertical positions, a first one of the positions corresponding to a locked or fully raised position and at least a second one of the positions corresponding to an unlocked or fully lowered position. The side rail(s) may also be configured so as to lock into one or more vertical positions between the fully raised and fully lowered positions, such as by including a detent operatively attached to the side rail(s). The lowered position facilitates access to the enclosed space containing the infant or small child. In this manner, the amount of effort that is required to, for instance, place the infant or small child over the top portion 110 of the side rail and into the enclosed space can be beneficially reduced. Then, once the infant or small child has been placed in the enclosed space, the side rail(s) can be raised to the locked position to maintain the infant or small child therein.

To enable the side rail(s) to slidably move in relation to the headboard and footboard, a track 130 or alternative slidable attachment means may be mounted to and/or formed within the support legs 126, 128 corresponding to the given side rail(s) having the adjustable vertical position feature. Various alternative arrangements for raising and lowering the side rails are contemplated by the present invention, as will be known by those skilled in the art.

Figure 7:
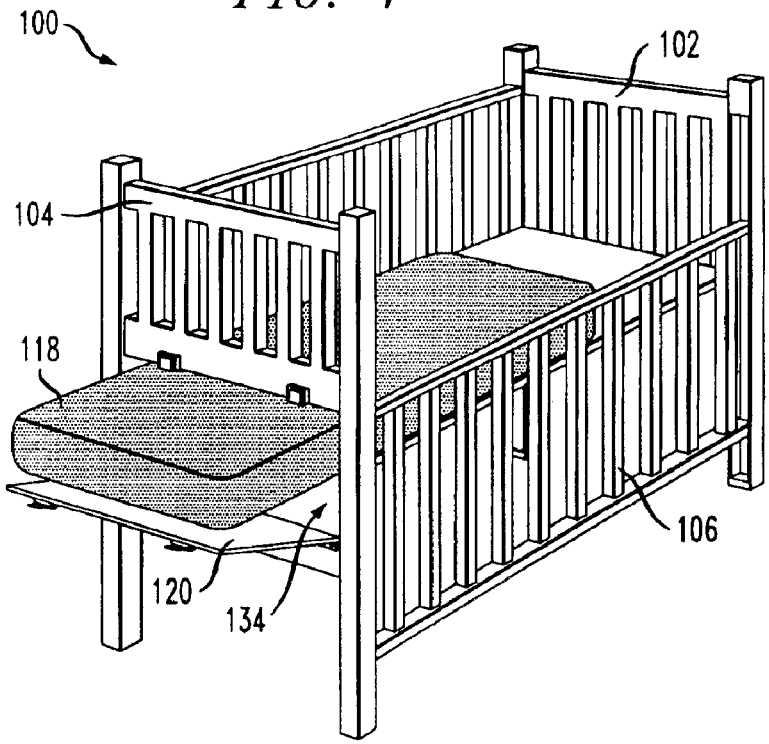
FIG. 7 is a perspective view illustrating the exemplary crib apparatus shown in FIG. 1 with the mattress partially removed and one of the side rails in a lowered position, in accordance with the present invention.

An important aspect of the present invention is that slide-out access to the mattress 118 is provided without inhibiting other features of the crib apparatus, including raising and lowering of the side rails(s) 106, 108. In order to allow the side rails 106, 108 to be advantageously lowered and raised while the mattress 118 is at least partially removed from the crib apparatus, an access opening 134 is provided in the headboard 102, the footboard 104, or both the headboard and footboard, through which the mattress 118 may pass, as depicted in FIG. 7. During normal use, for example when an infant or small child is placed in the crib apparatus, the access opening 134 is preferably covered by a corresponding access door or panel 120 operatively attached to the headboard 102 and/or footboard 104. The access panel 120 is preferably configured such that the infant or small child, while placed in the crib apparatus 100, cannot open the access panel and thereby remove the mattress 118. In order to accomplish this, the access panel 120 may include a locking mechanism to prevent such inadvertent removal of the mattress 118, as will be described in further detail below.

Figure 3:
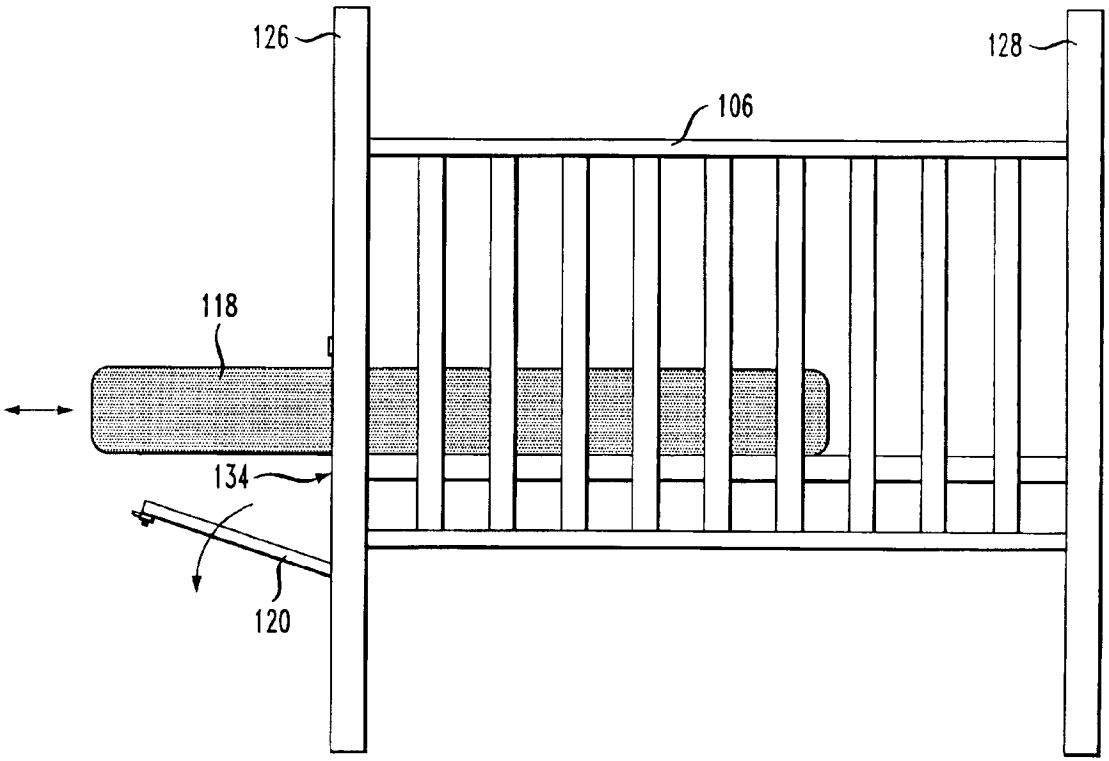
FIG. 3 is a side plan view illustrating a side rail of the exemplary crib apparatus shown in FIG. 1.
Figure 2:
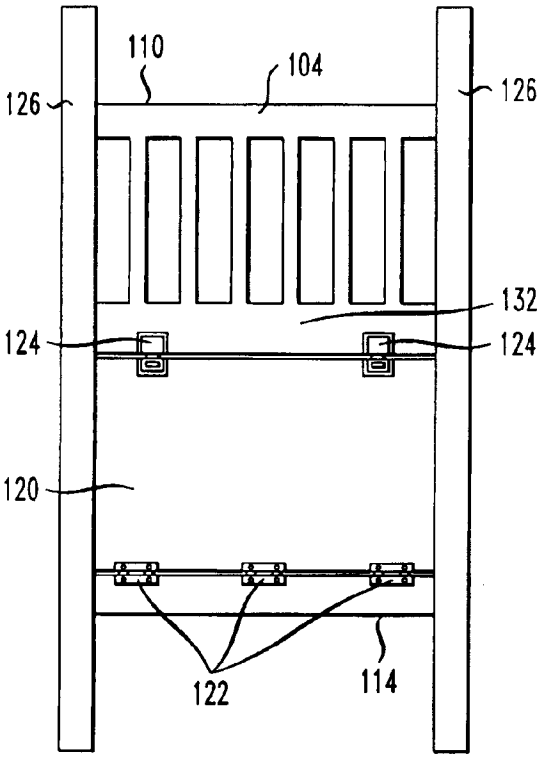
FIG. 2 is an end plan view illustrating the footboard of the exemplary crib apparatus shown in FIG. 1.
Figure 4:
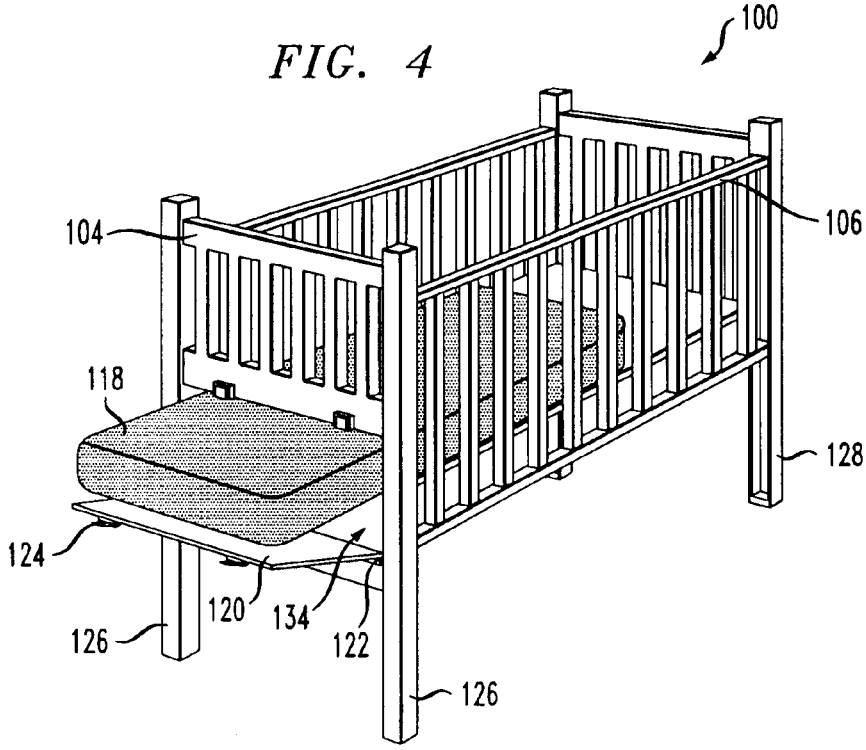
FIG. 4 is a perspective view illustrating the exemplary crib apparatus shown in FIG. 1 with the mattress partially removed, in accordance with the present invention.

FIGS. 2 through 4 illustrate various views of the exemplary crib apparatus 100 looking at the footboard 104, a side rail 106, and a perspective view of the footboard and side rail, respectively. As apparent from the figures, the access panel 120 is preferably pivotally mounted to the footboard 104, for example, via one or more hinges 122 attached to a side of the access panel and to the footboard. Alternatively, the access panel 120 may be removably attached to the crib apparatus 100, whereby the access panel can be removed entirely in order to expose the access opening 134. Preferably, the access panel 120 is pivotally mounted to the bottom portion 114 of the footboard 104 so that the access panel is able to swing down (e.g., by about ninety degrees) and out of the way while the mattress 118 is being slid out from the crib apparatus 100. When configured in this manner, the access panel 120 is preferably utilized as a support surface for the mattress 118 while the mattress is at least partially removed from the crib apparatus 100.

Alternatively, the access panel 120 may be pivotally mounted such that it can swing open to either side while sliding out the mattress 118 from the crib apparatus 100, such as, for example, by attaching the access panel 120 to one of the support legs 126 associated with the footboard 104. It is similarly contemplated that the access panel 120 may be pivotally mounted to a middle portion 132 of the footboard 104 so that the access panel 120 swings up while sliding out the mattress. In this case, a mechanism (not shown) may be included for holding the access panel open and out of the way so that both hands are free to slide out the mattress 118.

As previously stated, the access panel 120 may include a locking mechanism for beneficially preventing inadvertent removal of the mattress 118. The locking mechanism may be implemented in accordance with one or more latches 124 attached to the access panel 120 and to the footboard 104 for holding the access panel in a locked position during normal use (e.g., when an infant or small child is placed in the crib apparatus), thereby preventing the mattress from being slid out from the crib apparatus until desired. In a preferred embodiment, each of the latches 124 are arranged so that a first portion of the latch is attached to a top end of the access panel 120 and a second portion of the latch is attached to a corresponding location 132 on the footboard 104, as depicted in FIG. 2. It is to be appreciated that the access opening and corresponding access panel may be formed in and attached to, respectively, the headboard 102, either instead of or in addition to the access opening 134 and access panel 120 associated with the footboard 104, as previously described. Moreover, the number and/or placement of the latches 124 is not limited by the invention. Alternative locking arrangements suitable for use with the present invention are similarly contemplated, as will be understood by those skilled in the art.

Although shown in the figures as a solid door, the access panel 120 may be at least partially formed having one or more openings therein, for example, vertical bar members (not shown). The vertical bar members forming the access panel 120 may be configured so as to substantially match the vertical bar members, if employed, in the headboard and/or footboard in which the corresponding access opening 134 is formed. However, the one or more openings in the access panel 120 are preferably smaller than the mattress 118 itself so that the mattress cannot be removed from the crib apparatus 100 while the access panel is in its locked position. Alternative arrangements for holding the mattress 118 in place in the crib apparatus 100 are similarly contemplated by the present invention.

Figure 5:
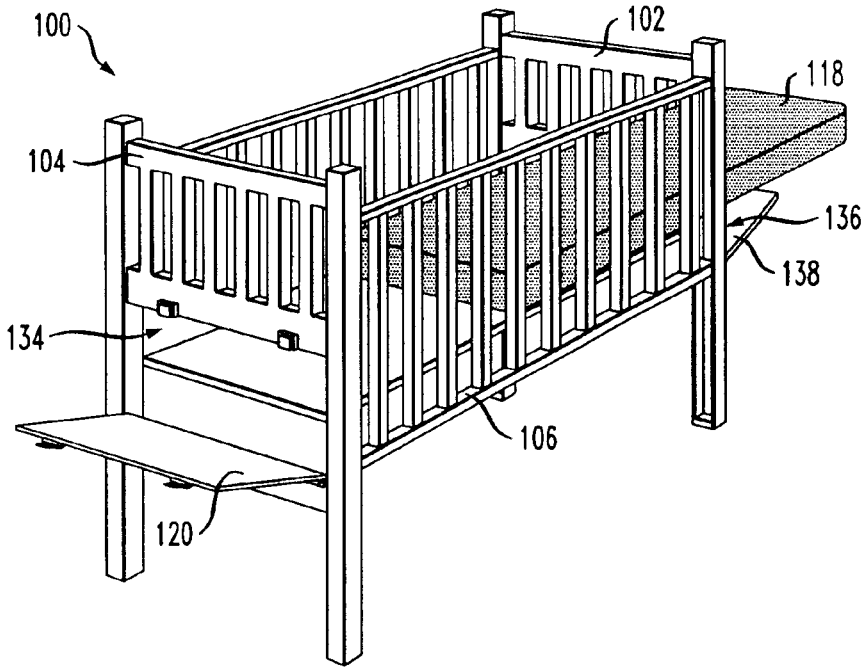
FIG. 5 is a perspective view of the exemplary crib apparatus shown in FIG. 1 including two access openings and with the mattress partially removed, in accordance with another embodiment of the present invention.
Figure 6:
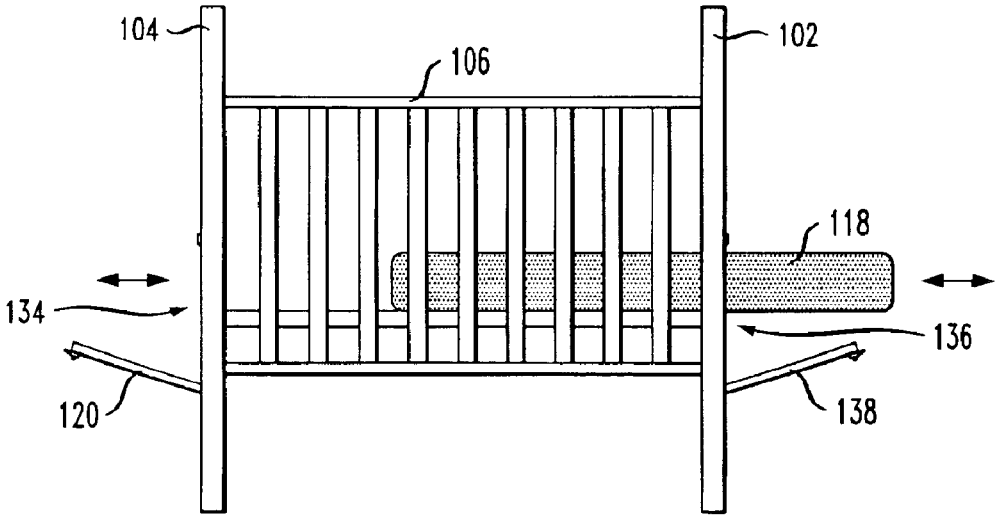
FIG. 6 is a side plan view illustrating a side rail of the exemplary crib apparatus shown in FIG. 5.

FIGS. 5 and 6 illustrate another embodiment of the present invention in which the exemplary crib apparatus 100 includes two access openings 134 and 136 formed in the footboard 104 and headboard 102, respectively, through which the mattress 118 can be slidably removed. This may be desirable, for example, to provide additional furniture configuration options, in the event one of the access openings is blocked by a wall or other furniture. Each access opening 134 and 136 preferably includes a corresponding access panel 120 and 138, respectively, which may be pivotally attached to the crib apparatus in a manner consistent with that previously described. Alternative means for attaching the access panels 120, 138 to the crib apparatus 100 are similarly contemplated by the invention.

At least for safety purposes, the crib apparatus may include alarm circuitry (not shown), or an alternative mechanism, for indicating whether or not the access panel 120 (or access panels, assuming more than one access panel is employed), is in the locked position, in accordance with another aspect of the invention. The alarm circuitry may include one or more position sensors (e.g., magnetic, infrared, etc.) that are configurable for detecting the relative position of the access panel 120 with respect to the latch 124 and/or the footboard 104 in which the access opening is formed. In an alternative embodiment of the invention, the alarm circuitry may, rather than detect the position of the access panel 120, detect the position of the mattress 118 and trigger an alarm condition when the mattress is slid out beyond a certain distance from the crib apparatus. It is to be appreciated that the alarm circuitry may also be used to detect and indicate the presence of other alarm conditions, such as, but not limited to, one or both of the side rails 106, 108 being in a lowered (i.e., unlocked) position, the infant or small child crying, a wet mattress, etc. The alarm circuitry may comprise a proximity detector, such as may be found in conventional burglar alarm systems, automatic garage door openers, etc., a sound detector (e.g., microphone), a moisture detector, etc., as may be required to sense and indicate the desired alarm condition(s). Alarm circuitry suitable for use with the present invention will be known by those skilled in the art.

When the alarm circuitry detects the presence of an alarm condition (e.g., the access panel door being unlocked, the mattress being slid out, etc.), the alarm circuitry is preferably configured to provide an indication so as to alert a person to the existence of a potentially dangerous condition. Alternatively, the alarm circuitry may be configured for providing a first indication (e.g., a green light) when the alarm condition is not detected (e.g., the access panel is locked, the mattress is not slid out, etc.) and for providing a second indication (e.g., a red light) or no indication when the alarm condition is detected. The indication provided by the alarm circuitry may be in an audible form (e.g., tones, computerized voice, etc.), in which case the indicator used may include, for example, a speaker. Likewise, the indication may be in a visual form, in which case the indicator used may include, for example, a light bulb, light-emitting diode (LED), etc. Other indication means, including tactile, etc., are similarly contemplated by the present invention. It is to be appreciated that more than one indicator and/or indication form may be utilized by the alarm circuitry. Furthermore, the alarm circuitry may be configurable for providing such indication(s) remotely, such as, for example, via a wired and/or wireless (e.g., radio frequency (RF), infrared, etc.) communication link, so as to monitor the status of the crib apparatus from another location, as will be understood by those skilled in the art.

Although illustrative embodiments of the present invention have been described herein with reference to the accompanying drawings, it is to be understood that the invention is not limited to those precise embodiments, and that various other changes and modifications maybe made therein by one skilled in the art without departing from the scope of the appended claims.

What is claimed is:

1. A crib apparatus, comprising:

a headboard and a footboard, the headboard and footboard being spaced from and arranged substantially parallel to one another;

first and second side rails, the first and second side rails being spaced from and arranged substantially parallel to one another and substantially orthogonal to the headboard and the footboard, each of the first and second side rails being operatively attached to the headboard and footboard; and a mattress frame for supporting a mattress, the mattress frame being operatively attached to at least the headboard and footboard and being substantially orthogonal to the headboard, footboard and side rails, the mattress frame being configured such that the mattress can be slidably removed from the crib apparatus in a substantially same plane relative to a position of the mattress during use;

wherein at least one of the headboard and the footboard includes an access opening formed therein through which the mattress can be slidably removed from the crib apparatus.

2. The crib apparatus of claim 1, further comprising at least one access panel configurable for preventing the mattress from being slidably removed through the access opening when the at least one access panel is in a first position and for providing access for slidably removing the mattress through the access opening when the at least one access panel is in a second position.

3. The crib apparatus of claim 2, further comprising a locking mechanism, the locking mechanism being configured so as to prevent removal of the mattress from the crib apparatus.

4. The crib apparatus of claim 3, wherein the locking mechanism comprises a first portion fixedly attached to the at least one access panel and a second portion fixedly attached to at least one of the headboard and the footboard, the first and second portions of the locking mechanism being coupled together while in a first position and being uncoupled from one another while in a second position.

5. The crib apparatus of claim 2, wherein the at least one access panel is pivotally attached to at least one of the headboard and the footboard, the access panel being configured so as to provide a surface for supporting the mattress while the mattress is slidably removed from the crib apparatus.

6. The crib apparatus of claim 1, wherein at least one of the first and second side rails is configured such that a height of the at least one side rail can be lowered and raised, in relation to the headboard and footboard, between a plurality of vertical positions, a first one of the positions corresponding to a locked position and at least a second one of the positions corresponding to a lowered position.

7. The crib apparatus of claim 6, wherein the crib apparatus is configured such that the at least one side rail can be placed in the lowered position when the mattress is at least partially slid out from the crib apparatus.

8. The crib apparatus of claim 1, wherein the mattress frame is slidably attached to at least the headboard and footboard, the mattress frame being configured such that the mattress frame can be slid out substantially horizontally from the crib apparatus through the access opening in at least one of the headboard and footboard.

9. The crib apparatus of claim 1, wherein the mattress frame is configurable for selectively adjusting a height of the mattress.

10. The crib apparatus of claim 1, wherein at least one of the headboard, footboard, and first and second side rails is at least partially formed having a plurality of spaced vertical bar members.

11. The crib apparatus of claim 1, wherein each of the headboard and the footboard include at least two support legs spaced laterally from one another at opposite ends of the headboard and footboard, each of the support legs including a plurality of vertically spaced attachment positions, the height of the attachment positions on a given support leg being substantially the same as corresponding attachment positions associated with the other support legs, whereby a height of the mattress frame is selectively adjustable by attaching the mattress frame to the support legs at corresponding attachment positions on the support legs.

12. The crib apparatus of claim 1, further comprising alarm circuitry for at least one of detecting and indicating a presence of an alarm condition.

13. The crib apparatus of claim 1, further comprising a plurality of support legs, each of the support legs being attached to a corresponding corner of the mattress frame, the support legs being configurable for selectively adjusting a height of the crib apparatus.

14. The crib apparatus of claim 1, wherein a width of the first and second side rails is greater than a width of at least one of the headboard and the footboard.

15. A crib apparatus, comprising:

a headboard and a footboard, the headboard and footboard being spaced from and arranged substantially parallel to one another;

first and second side rails, the first and second side rails being spaced from and arranged substantially parallel to one another and substantially orthogonal to the headboard and the footboard, each of the first and second side rails being operatively attached to the headboard and footboard;

a mattress frame for supporting a mattress, the mattress frame being operatively attached to at least the headboard and footboard and being substantially orthogonal to the headboard, footboard and side rails; and at least one slidable track assembly, the slidable track assembly having a first portion fixedly attached to at least one of the headboard and the footboard and a second portion fixedly attached to the mattress frame, the first and second portions of the track assembly being slidably attached together in relation to one another so as to enable the mattress frame to be slidably removed from the crib apparatus in a substantially horizontal manner;

wherein at least one of the headboard and the footboard includes an access opening formed therein through which the mattress can be slidably removed from the crib apparatus.

16. A crib apparatus, comprising:

a headboard and a footboard, the headboard and footboard being spaced from and arranged substantially parallel to one another;

first and second side rails, the first and second side rails being spaced from and arranged substantially parallel to one another and substantially orthogonal to the headboard and the footboard, each of the first and second side rails being operatively attached to the headboard and footboard;

a mattress frame for supporting a mattress, the mattress frame being operatively attached to at least the headboard and footboard and being substantially orthogonal to the headboard, footboard and side rails; and alarm circuitry for at least one of detecting and indicating a presence of an alarm condition;

wherein at least one of the headboard and the footboard includes an access opening formed therein through which the mattress can be slidably removed from the crib apparatus;

wherein the alarm circuitry is configurable for detecting a relative position of the mattress with respect to the crib apparatus and providing an indication when the mattress is slid out from the crib apparatus beyond a predetermined distance.

17. The crib apparatus of claim 16, wherein the alarm indication comprises at least one of an audible indicator and a visual indicator.

18. The crib apparatus of claim 16, wherein the alarm circuitry is configurable for providing an indication of the presence of the alarm condition to a remote location.

19. A crib apparatus, comprising:

a headboard and a footboard, the headboard and footboard being spaced from and arranged substantially parallel to one another;

first and second side rails, the first and second side rails being spaced from and arranged substantially parallel to one another and substantially orthogonal to the headboard and the footboard, each of the first and second side rails being operatively attached to the headboard and footboard; and a mattress frame for supporting a mattress, the mattress frame being operatively attached to at least the headboard and footboard and being substantially orthogonal to the headboard, footboard and side rails;

wherein at least one of the headboard and the footboard includes an access opening formed therein through which the mattress can be slidably removed from the crib apparatus:

wherein the mattress frame comprises a substantially solid tray in which or on which the mattress is supported, the tray being slidably mounted in relation to at least one of the headboard, footboard and side rails.

20. The crib apparatus of claim 19, wherein the tray includes at least one opening formed therein to facilitate grasping of the mattress frame for sliding the mattress from the crib apparatus.

* * * * *